US011846163B2

(12) United States Patent
Kash et al.

(10) Patent No.: US 11,846,163 B2
(45) Date of Patent: Dec. 19, 2023

(54) INITIATOR ASSEMBLIES FOR PERFORATING GUN SYSTEMS

(71) Applicant: G&H Diversified Manufacturing LP, Houston, TX (US)

(72) Inventors: James Edward Kash, Houston, TX (US); Benjamin Vascal Knight, Katy, TX (US); Ryan Ward, Tomball, TX (US); Timmothy Lee, Tomball, TX (US); Charles Levine, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 69 days.

(21) Appl. No.: 17/376,569

(22) Filed: Jul. 15, 2021

(65) Prior Publication Data

US 2022/0018227 A1 Jan. 20, 2022

Related U.S. Application Data

(60) Provisional application No. 63/169,182, filed on Mar. 31, 2021, provisional application No. 63/052,415, filed on Jul. 15, 2020.

(51) Int. Cl.

| | |
|---|---|
| ***E21B 43/1185*** | (2006.01) |
| ***F42D 1/05*** | (2006.01) |
| ***E21B 43/117*** | (2006.01) |
| ***F42D 1/04*** | (2006.01) |

(52) U.S. Cl.

CPC ..... *E21B 43/1185* (2013.01); *E21B 43/117* (2013.01); *F42D 1/043* (2013.01); *F42D 1/05* (2013.01)

(58) Field of Classification Search

CPC ..... E21B 43/1185; E21B 43/11855; E21B 43/117; F42D 1/043; F42D 1/05

See application file for complete search history.

(56) References Cited

U.S. PATENT DOCUMENTS

| | | | | |
|---|---|---|---|---|
| 8,468,944 | B2 * | 6/2013 | Givens | F42B 3/121 102/311 |
| 2014/0000877 | A1 * | 1/2014 | Robertson | E21B 23/00 166/250.15 |
| 2018/0216446 | A1 * | 8/2018 | Allison | E21B 43/26 |
| 2019/0195054 | A1 * | 6/2019 | Bradley | E21B 43/116 |
| 2020/0332630 | A1 * | 10/2020 | Davis | E21B 43/119 |

* cited by examiner

*Primary Examiner* — Blake Michener
*Assistant Examiner* — Yanick A Akaragwe
(74) *Attorney, Agent, or Firm* — Conley Rose, P.C.

(57) ABSTRACT

A perforating gun system includes an outer housing, a charge carrier assembly slidably receivable in the outer housing, wherein the charge carrier assembly includes a charge carrier having a central axis, a first endplate coupled to a first end of the charge carrier, and a second endplate coupled to a second end of the charge carrier, and an initiator assembly including an electrical switch, wherein the electrical switch has a maximum length extending in a direction parallel the central axis that is less than a maximum width of the electrical switch extending in an orthogonal direction relative to the central axis; wherein the electrical switch is configured to detonate a detonator of the perforating gun system in response to receiving a firing signal.

33 Claims, 12 Drawing Sheets

INITIATOR ASSEMBLIES FOR PERFORATING GUN SYSTEMS

CROSS-REFERENCE TO RELATED APPLICATIONS

This application claims benefit of U.S. provisional patent application Ser. No. 63/052,415 filed Jul. 15, 2020, and entitled "Initiator Assemblies for Perforating Gun Systems," and U.S. provisional patent application Ser. No. 63/169,182 filed Mar. 31, 2021, and entitled "Initiator Assemblies for Perforating Gun Systems," each of which is hereby incorporated herein by reference in its entirety for all purposes.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun system at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices of the perforating gun system are installed within the wellbore between each production zone prior to perforation activities. In some applications, one or more of the perforating guns and/or other components of the perforating gun system may comprise a detonator for firing a charge or explosive. For instance, a perforating gun of the perforating gun system may comprise an initiator assembly configured to initiate an explosion of one or more shaped charged of the perforating gun in response to receiving an electrical signal from the surface. As part of the effort of completing a wellbore such that it may produce hydrocarbons, it is valuable to minimize the time required for completing the wellbore while also configuring the completed wellbore for maximal production of hydrocarbons over its lifespan. One area of interest is maximizing the number of perforations formed in the wellbore in order to maximize hydrocarbon production from the wellbore but without substantially increasing the time and expense required in completing the wellbore.

SUMMARY OF THE DISCLOSURE

An embodiment perforating gun system comprises an outer housing, a charge carrier assembly slidably receivable in the outer housing, wherein the charge carrier assembly comprises a charge carrier having a central axis, a first endplate coupled to a first end of the charge carrier, and a second endplate coupled to a second end of the charge carrier, and an initiator assembly comprising an electrical switch, wherein the electrical switch has a maximum length extending in a direction parallel the central axis that is less than a maximum width of the electrical switch extending in an orthogonal direction relative to the central axis, wherein the electrical switch is configured to detonate a detonator of the perforating gun system in response to receiving a firing signal. In some embodiments, the initiator assembly is receivable in a receptacle of the second endplate. In some embodiments, the second endplate comprises a plurality of circumferentially spaced tabs configured to snap onto a housing of the initiator assembly in which the electrical switch is received. In certain embodiments, the second endplate comprises a plurality of female electrical contacts and the initiator assembly comprises a plurality of male electrical contacts receivable in the plurality of female electrical contacts. In certain embodiments, the perforating gun system comprises an electrical connector which extends through a central passage of the second endplate and a central passage of the initiator assembly. In some embodiments, the perforating gun system comprises an interrupter insertable through an opening formed in a housing that receives the electrical switch and into a detonator holder of the second endplate, wherein the interrupter is configured to prevent a transfer of a ballistic signal between the detonator and a detonating cord receivable in the detonator holder when the interrupter is received in a detonator holder, wherein the interrupter is configured to permit the transfer of the ballistic signal between the detonator and the detonating cord when the interrupter is received in a detonator holder. In some embodiments, a ratio of the maximum length to the maximum width of the electrical switch is less than 1:1. In some embodiments, a ratio of the maximum length to the maximum width of the electrical switch is less than 1:3. In some embodiments, a ratio of the maximum length to the maximum width of the electrical switch is less than 1:6. In certain embodiments, the electrical switch is arcuate in shape. In certain embodiments, the electrical switch is rectangular in shape. In some embodiments, the electrical switch is V-shaped. In some embodiments, a printed circuit board (PCB) of the electrical switch is oriented generally orthogonal the central axis.

An embodiment of a charge carrier assembly for a perforating gun system comprises a cylindrical charge carrier having a central axis, a first endplate coupled to a first end of the charge carrier, a second endplate coupled to a second end of the charge carrier, and an initiator assembly comprising an electrical switch, wherein the electrical switch has a maximum length extending in a direction parallel the central axis that is less than a maximum width of the electrical switch extending in an orthogonal direction relative to the central axis, wherein the electrical switch is configured to detonate the detonator in response to receiving a firing signal. In some embodiments, the initiator assembly is receivable in a receptacle of the second endplate. In some embodiments, the second endplate comprises a plurality of circumferentially spaced tabs configured to snap onto a housing of the initiator assembly in which the electrical switch is received. In some embodiments, the second endplate comprises a plurality of female electrical contacts and the initiator assembly comprises a plurality of male electrical contacts receivable in the plurality of female electrical contacts. In certain embodiments, the charge carrier assembly comprises an electrical connector which extends through a central passage of the second endplate and a central passage of the initiator assembly. In certain embodiments, the charge carrier assembly comprises an interrupter insertable through an opening formed in a housing of the initiator assembly that receives the electrical switch. In some embodiments, a ratio of the maximum length to the maximum width of the electrical switch is less than 1:1. In some embodiments, a ratio of the maximum length to the maximum width of the electrical switch is less than 1:3. In certain embodiments, a ratio of the maximum length to the maximum width of the electrical switch is less than 1:6. In some embodiments, the electrical switch is arcuate in shape. In some embodiments, the electrical switch is rectangular in shape. In certain embodiments, the electrical switch is V-shaped. In some embodiments, a printed circuit board (PCB) of the electrical switch is oriented generally orthogonal the central axis.

An embodiment of a method for assembling a charge carrier assembly for a perforating gun system comprises (a) coupling a first endplate and a second endplate to a charge carrier having a central axis, (b) inserting a detonator into a detonator holder of the second endplate, and (c) coupling an initiator assembly comprising an electrical switch to the charge carrier, wherein the electrical switch has a maximum length extending in a direction parallel the central axis that is less than a maximum width of the electrical switch extending in an orthogonal direction relative to the central axis, and wherein the electrical switch is configured to detonate the detonator in response to receiving a firing signal. In some embodiments, the method comprises (d) inserting an interrupter through an opening formed in a housing of the initiator assembly. In some embodiments, the second endplate comprises a plurality of circumferentially spaced tabs configured to snap onto a housing of the initiator assembly. In some embodiments, the second endplate comprises a plurality of female electrical contacts and the initiator assembly comprises a plurality of male electrical contacts receivable in the plurality of female electrical contacts. In certain embodiments, a ratio of the maximum length to the maximum width of the electrical switch is less than 1:1. In certain embodiments, a ratio of the maximum length to the maximum width of the electrical switch is less than 1:3. In some embodiments, a ratio of the maximum length to the maximum width of the electrical switch is less than 1:6. In some embodiments, the electrical switch is arcuate in shape. In certain embodiments, the electrical switch is rectangular in shape. In certain embodiments, the electrical switch is V-shaped. In certain embodiments, a printed circuit board (PCB) of the electrical switch is oriented generally orthogonal the central axis.

BRIEF DESCRIPTION OF THE DRAWINGS

For a detailed description of exemplary embodiments of the disclosure, reference will now be made to the accompanying drawings in which.

DETAILED DESCRIPTION

Figure 1:
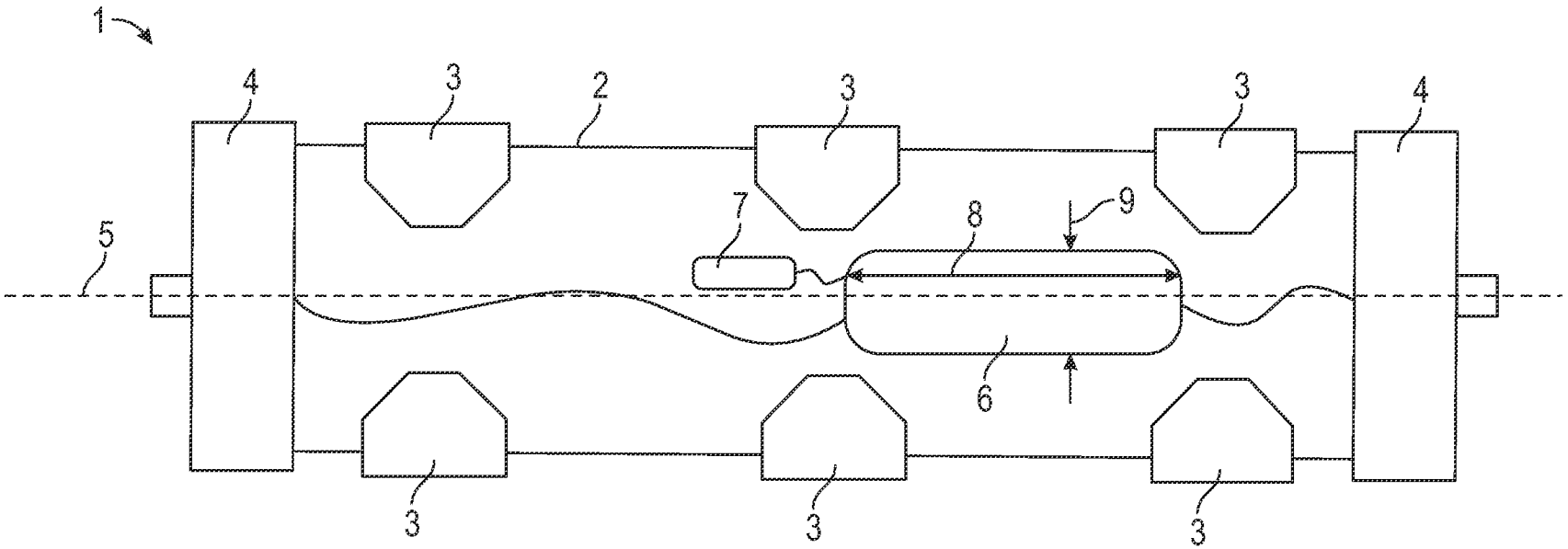
FIG. 1 (Prior Art)
FIG. 1 is a schematic view of a conventional perforating gun.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

As described above, during completion operations for a subterranean wellbore, it is conventional practice to perforate the wellbore and any casing pipes disposed therein with a perforating gun system at each production zone to provide a path(s) for formation fluids to flow from a production zone of a subterranean formation into the wellbore. The perforating gun system may comprise a tool string insertable into the wellbore via a wireline extending from the tool string to the surface. The tool string may be insertable into the wellbore via a surface assembly of the perforating gun system and may include a plurality of perforating guns and associated components such as a downhole plug, a setting tool for setting the downhole plug, as well as other components.

For example, referring to FIG. 1, a conventional perforating gun 1 is shown. Perforating gun 1 has a central or longitudinal axis 5 and includes a charge carrier 2 which receives a plurality of shaped charges 3, a pair of endplates 4 coupled to opposing ends of the charge carrier 2, an electrical switch 6, and a detonator 7. Electrical switch may be electrically connected to electrical connectors positioned within the endplates 4 to permit an electrical connection to be formed between electrical switch 6 and a surface assembly of a conventional perforating gun system comprising perforating gun 1. Additionally, electrical switch 6 may be electrically connected to the detonator 6 whereby electrical switch 6 may detonate the detonator 7. Detonator 7 is in-turn ballistically connected to shaped charges 3 by a detonating or "det" cord (not shown in FIG. 1) such that detonation of detonator 7 results in the detonation of shaped charges 3. In the conventional perforating gun 1 shown in FIG. 1, electrical switch 6 has a maximum axial length 8 extending in a direction parallel central axis 5 that is greater than a maximum width 9 of the electrical switch 6 extending in a direction orthogonal central axis 5.

In at least some applications, it may be advantageous to include a relatively larger number of perforating guns in the tool string as a large number of perforating guns allows for a correspondingly relatively large number of different zones of the formation through which the wellbore extends to be separately stimulated or fractured. The fracturing of a large number of different production zones may in-turn, in at least some applications, maximize the production of hydrocarbons from the formation following completion of the wellbore. However, the overall or total length of the tool string may be limited by the configuration of the surface assembly used to insert the tool string into the wellbore. For example, a lifting crane of the surface assembly may have a maximum height at which it may operate, thereby limiting the total length of the tool string to a length that is less than the maximum lifting height of the crane minus the height of any surface equipment over which the tool string must be lifted such as, for example, a wellhead located at the surface of the wellbore. Thus, the number of perforating guns which may be included in a single tool string may be limited given the restriction placed on the maximum permissible length of the tool string.

Moreover, in at least some applications, the axial length of each perforating gun must be great enough to accommodate an electrical switch thereof. For example, the length of the electrical switch 6 of conventional perforating gun 1 may act as a choke point when minimizing the length of perforating gun 1 given that perforating gun 1 must be large enough to accommodate the maximum axial length 8 of electrical switch 6. This would still hold true even if electrical switch 6 were located external to charge carrier 2 as sufficient space would still need to be provided in the tool string comprising perforating gun 1 to accommodate the electrical switch 6.

Accordingly, embodiments of perforating gun systems disclosed herein include perforating guns having a relatively reduced or minimized axial length. By minimizing the axial length of each perforating gun of the tool string, the number of perforating guns that can be fit into a tool string that is at or less than the maximum permissible length thereof may be maximized. The increased number of perforating guns in the tool string may allow for the stimulation of an increased number of production zones of the formation, thereby potentially increasing the production of hydrocarbons from formation. Particularly, embodiments of perforating gun systems disclosed herein include charge carrier assemblies each including an initiator assembly configured to selectably detonate one or more shaped charges of the charge carrier assembly. The initiator assembly includes an electrical switch (e.g., a digital addressable switch, a diode switch, etc.) having minimal axial length such that an overall or total axial length of the perforating gun comprising the electrical switch is minimized. Particularly, embodiments of electrical switches disclosed herein have a maximum length in the axial direction (parallel the central axis of the perforating gun) which is less than a maximum width in the orthogonal direction (orthogonal a central axis of the perforating gun) whereby the axial length of the electrical switch is minimized, thereby minimizing the total axial length of the perforating gun.

Figure 2:
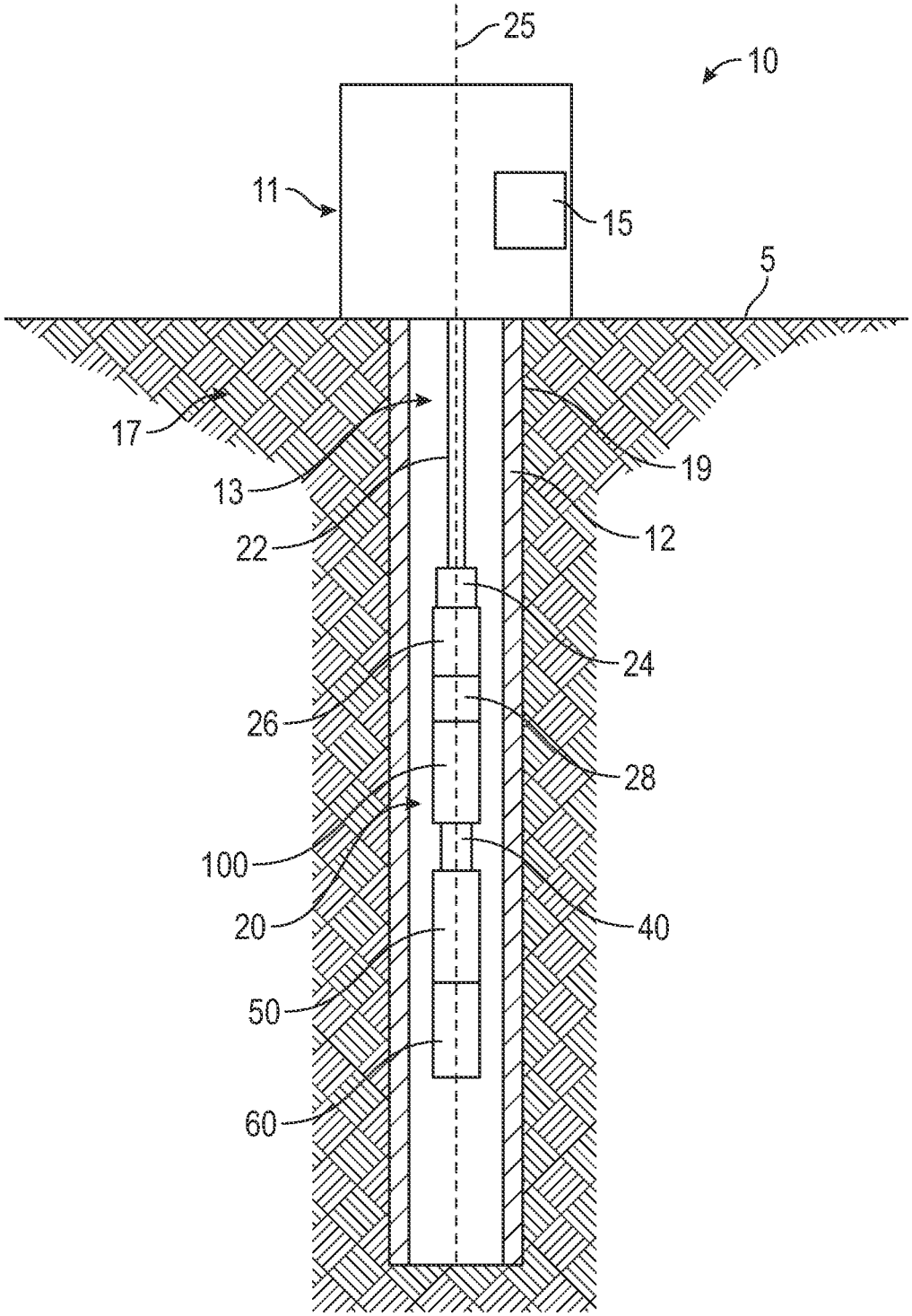
FIG. 2 is a schematic, view of an embodiment of a system for completing a subterranean well including a tool string.

Referring now to FIG. 2, a perforating gun or completion system 10 for completing a wellbore 13 extending into a subterranean formation 17 is shown. In the embodiment of FIG. 2, wellbore 13 is a cased wellbore including a casing string 12 secured to an inner surface 19 of the wellbore 13 using cement (not shown). In some embodiments, casing string 12 generally includes a plurality of tubular segments coupled together via a plurality of casing collars. Completion system 10 includes a surface assembly 11 positioned at a wellsite 13 of system 10, and a tool string 20 deployable into wellbore 13 from a surface 5 using surface assembly 11. Surface assembly 11 may comprise any suitable surface equipment for drilling, completing, and/or operating well 20 and may include, in some embodiments, derricks, structures, pumps, electrical/mechanical well control components, etc. Tool string 20 of completion system 10 may be suspended within wellbore 13 from a wireline 22 that is extendable from surface assembly 11. Wireline 22 comprises an armored cable and includes at least one electrical conductor for transmitting power and electrical signals between tool string 20 and a control system or firing panel 15 of surface assembly 11 positioned at the surface 5.

In some embodiments, system 10 may further include suitable surface equipment for drilling, completing, and/or operating completion system 10 and may include, for example, derricks, structures, pumps, electrical/mechanical well control components, etc. Tool string 20 is generally configured to perforate casing string 12 to provide for fluid communication between formation 17 and wellbore 13 at predetermined locations to allow for the subsequent hydraulic fracturing of formation 17 at the predetermined locations.

In this exemplary embodiment, tool string 20 has a central or longitudinal axis 25 and generally includes a cable head 24, a casing collar locator (CCL) 26, a direct connect sub 28, one or more perforating guns or tools 100, a setting tool initiator or plug-shoot firing head (PSFH) 40, a setting tool 50, and a downhole or frac plug 60. It may be understood that in other embodiments the configuration of tool string 20 may vary from that shown in FIG. 2. For example, in other embodiments, tool string 20 may not include each of the components shown in FIG. 2, and/or may include additional components not shown in FIG. 2 such as a fishing neck, one or more weight bars, a release tool a safety sub, etc.

Cable head 24 is the uppermost component of tool string 20 and includes an electrical connector for providing electrical signal and power communication between the wireline 22 and the other components (CCL 26, perforating gun 100, PSFH 40, setting tool 50, etc.) of tool string 20. CCL 26 is coupled to a lower end of the cable head 24 and is generally configured to transmit an electrical signal to the surface via wireline 22 when CCL 26 passes through a casing collar of casing string 12. In some embodiments, the signal transmitted by CCL 26 may be recorded at surface assembly 11 as a collar kick to determine the position of tool string 20 within wellbore 13 by correlating the recorded collar kick with an open hole log. The direct connect sub 28 is coupled to a lower end of CCL 26 and is generally configured to provide a connection between the CCL 26 and the portion of tool string 20 including perforating gun 100 and associated tools, such as the setting tool 50 and downhole plug 60.

Perforating gun 100 of tool string 20 is coupled to direct connect sub 28 and, as will be discussed further herein, is generally configured to perforate casing string 12 and provide for fluid communication between formation 17 and wellbore 13. Particularly, perforating gun 100 may include a plurality of shaped charges that may be detonated by one or more electrical signals conveyed by the wireline 22 from the firing panel 15 of surface assembly 11 to produce one or more explosive jets directed against casing string 12. Perforating gun 100 may comprise a wide variety of sizes such as, for example, 2¾", 3⅛", or 3⅜", wherein the above listed size designations correspond to an outer diameter of perforating gun 100. PSFH 40 of tool string 20 is coupled to a lower end of perforating gun 100. PSFH 40 couples the perforating gun 100 of the tool string 20 to the setting tool 50 and downhole plug 60 and is generally configured to pass a signal from the wireline 22 to the setting tool 50 of tool string 20. PSFH 40 may also include electrical components to fire the setting tool 50 of tool string 20. In some embodiments, tool string 20 may not include PSFH 40, and instead, perforating gun 100 may control the operation of setting tool 50.

In this embodiment, tool string 20 further includes setting tool 50 and downhole plug 60, where setting tool 50 is coupled to a lower end of PSFH 40 and is generally configured to set or install downhole plug 60 within casing string 12 to fluidically isolate desired segments of the wellbore 13. Once downhole plug 60 has been set by setting tool 50, an outer surface of downhole plug 60 seals against an inner surface of casing string 12 to restrict fluid communication through wellbore 13 across downhole plug 60. Downhole plug 60 of tool string 20 may be any suitable downhole or frac plug known in the art while still complying with the principles disclosed herein.

Figure 3:
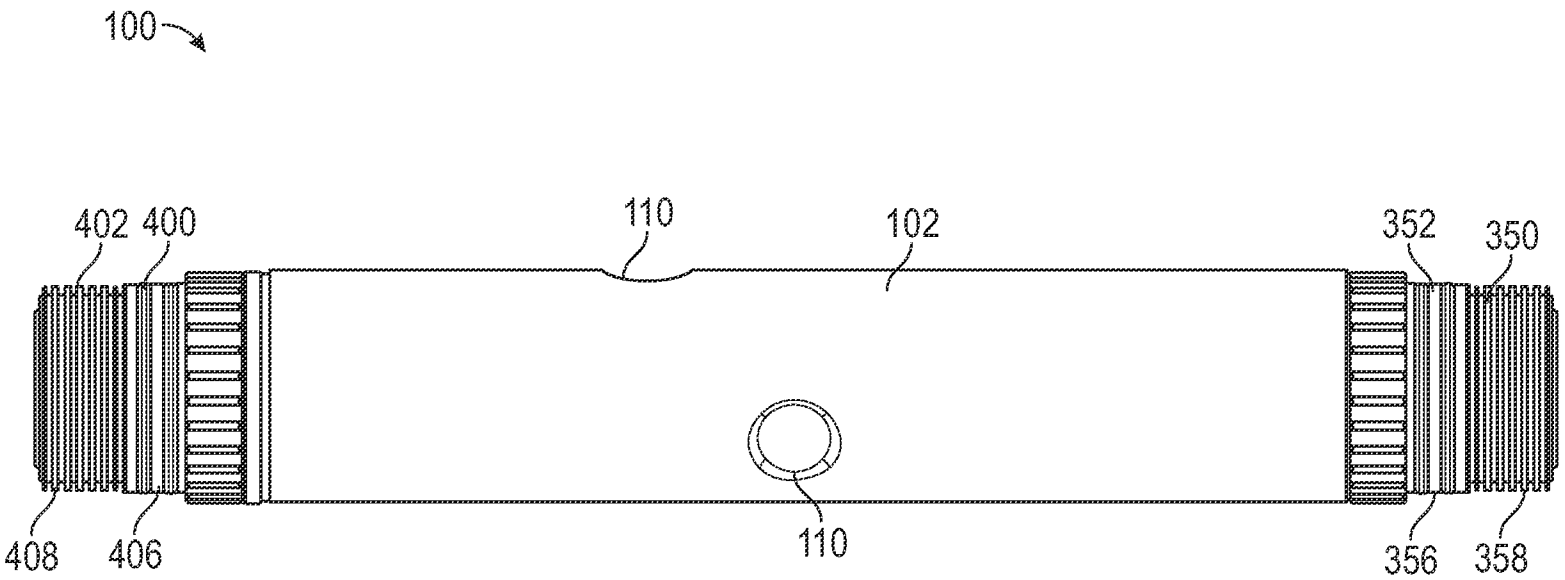
FIG. 3 is a side view of an embodiment of a perforating gun of the system of FIG. 2.
Figure 4:
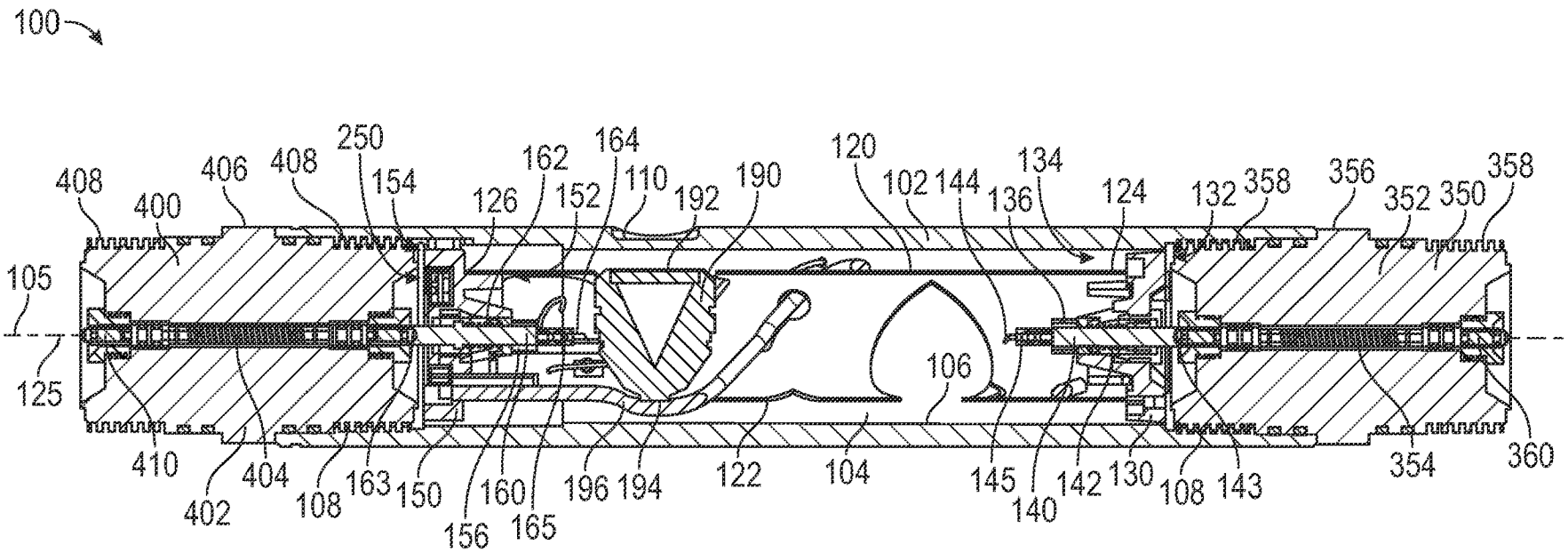
FIG. 4 is a side cross-sectional view of the perforating gun of FIG. 3.
Figure 5:
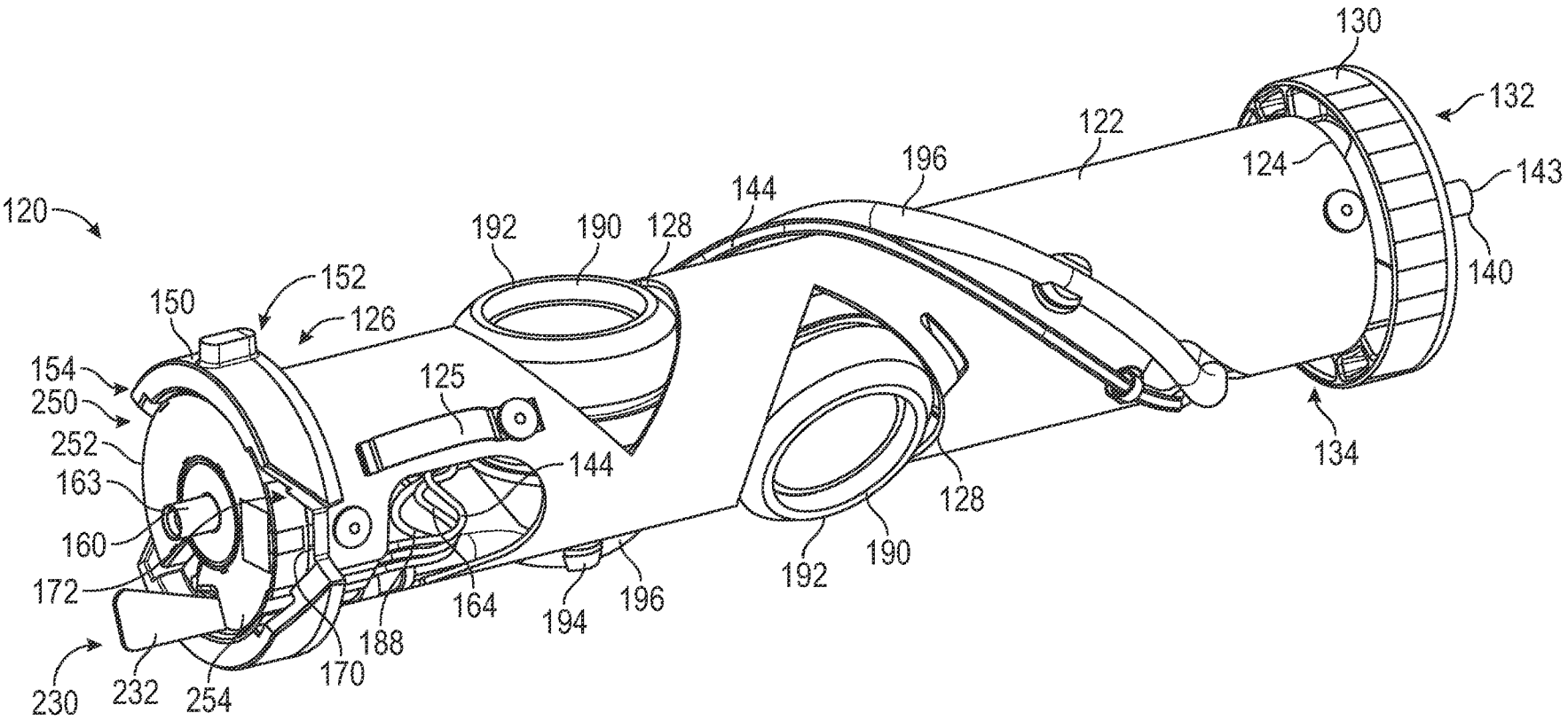
FIGS. 5, 6 are perspective views of an embodiment of a charge carrier assembly of the perforating gun of FIG. 3.

Referring to FIGS. 3, 4, an embodiment of the perforating gun 100 is shown. In this exemplary embodiment, perforating gun 100 has a central or longitudinal axis 105 and generally includes a tubular carrier or outer housing 102, a charge carrier assembly 120 receivable within the outer housing 102, an initiator assembly 250, a first or upper bulkhead sub 350 connectable to the outer housing 102, and a second or lower bulkhead sub 400 connectable to the outer housing 102.

The outer housing 102 of perforating gun 100 includes a central bore or passage 104 within which charge carrier assembly 120 is received. A generally cylindrical inner surface 106 defined by central passage 104 may include a releasable or threaded connector 108 at each longitudinal end of outer housing 102. In some embodiments, a generally cylindrical outer surface of the outer housing 102 may include a plurality of circumferentially and axially spaced recesses or scallops 110 to assist with the firing of perforating gun 100; however, in other embodiments, outer housing 102 may not include scallops 110.

Referring to FIGS. 4-13, views of the charge carrier assembly 120 and components thereof are shown. The charge carrier assembly 120 of perforating gun 100 generally includes a charge carrier 122 having a longitudinal or central axis 123 coaxial with central axis 105, a first or upper endplate 130, and a second or lower endplate 150. In this exemplary embodiment, charge carrier 122 comprises a cylindrical charge tube; however, in other embodiments, the shape and configuration of charge carrier 122 may vary. The upper endplate 130 is coupled to a first or upper end 124 of charge carrier 122 while the lower endplate 150 is coupled to a second or lower end 126 of the charge carrier 122 opposite the upper end 124. A plurality of circumferentially and axially spaced shaped charges 190 (only one of which is shown in FIG. 4 for clarity) are positioned in circumferentially spaced apertures 128 formed in charge carrier 122. Particularly, each shaped charge 190 has a first end 192 angularly oriented towards one of the scallops 110 of the outer housing 102, and a second end 194 opposite the first end 192. While in this exemplary embodiment the charge carrier assembly 120 includes a plurality of shaped charges 190, in other embodiments, charge carrier assembly 120 may include only a single shaped charge 190.

Each shaped charge 190 may comprise an outer housing and an explosive material stored within the housing and which may be detonated in response to detonation of a detonation or det cord 196 of charge carrier assembly 120. Det cord 196 extends through charge carrier 122. Particularly, each shaped charge 190 is configured to initiate an explosion and emit an explosive charge from the first end 192 and through one of the scallops 110 of outer housing 102 in response to receiving a ballistic signal from the det cord 196 extending through the charge carrier 122 to which the shaped charge 190 is coupled. Det cord 196 may contact or otherwise be ballistically coupled to the second end 194 of each shaped charge 190. In this manner, det cord 196 of perforating gun 100 may communicate a ballistic signal to each of the shaped charges 190 of the perforating gun 100.

The upper endplate 130 of charge carrier assembly 120 may be generally annular in shape and have a first or upper end 132 facing the upper bulkhead sub 350, a second or lower end 134 opposite upper end 132 and coupled to the upper end 124 of charge carrier 122, and a central passage 136 extending from the upper end 132 to the lower end 134. In some embodiments, upper endplate 130 may comprise an electrically insulating material. In this exemplary embodiment, upper endplate 130 comprises a first or upper electrical connector 140 slidably positioned within the central passage 136 of upper endplate 130. Signal communication between components of perforating gun 100, such as initiator assembly 250, and the surface assembly 11 may be provided by upper electrical connector 140. In some embodiments, upper electrical connector 140 may comprise a biasing member or spring 142 configured to bias a first or upper end 143 of upper electrical connector 140 into electrical contact with upper bulkhead sub 350. A first signal conductor or electrical cable 144 may be connected to a second or lower end 145 (opposite upper end 143) of upper electrical connector 140 and may extend through the charge carrier 122 of charge carrier assembly 120.

The lower endplate 150 of charge carrier assembly 120 may be generally annular in shape and have a first or upper end 152 coupled to the lower end 126 of charge carrier 122, a second or lower end 154 opposite upper end 152 and facing the lower bulkhead sub 400, and a central passage 156 extending from the upper end 152 to the lower end 154. In some embodiments, upper endplate 150 may comprise an electrically insulating material. In this exemplary embodiment, lower endplate 150 comprises a second or lower electrical connector 160 slidably positioned within the central passage 156 of lower endplate 150. Signal communication between components positioned downhole of perforating gun 100 (e.g., setting tool 50, etc.) and perforating gun 100 may be provided by lower electrical connector 160. In some embodiments, lower electrical connector 160 may comprise a biasing member or spring 162 configured to bias a first or lower end 163 of lower electrical connector 160 into electrical contact with lower bulkhead sub 400. A second signal conductor or electrical cable 164 may be connected to a second or upper end 165 (opposite first end 163) of lower electrical connector 160 and may extend through the charge carrier 122 of charge carrier assembly 120.

Figure 6:
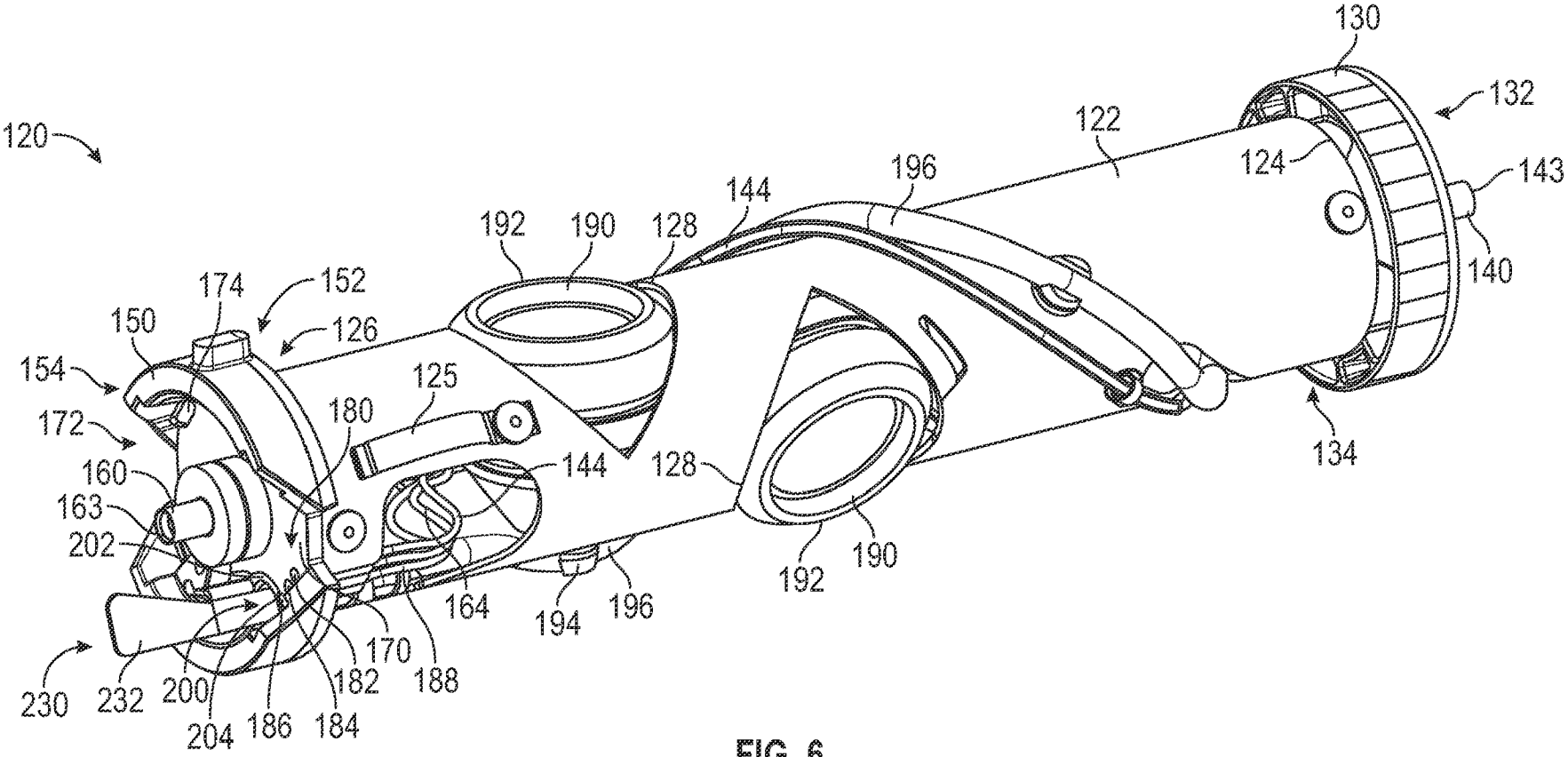
Figure 8:
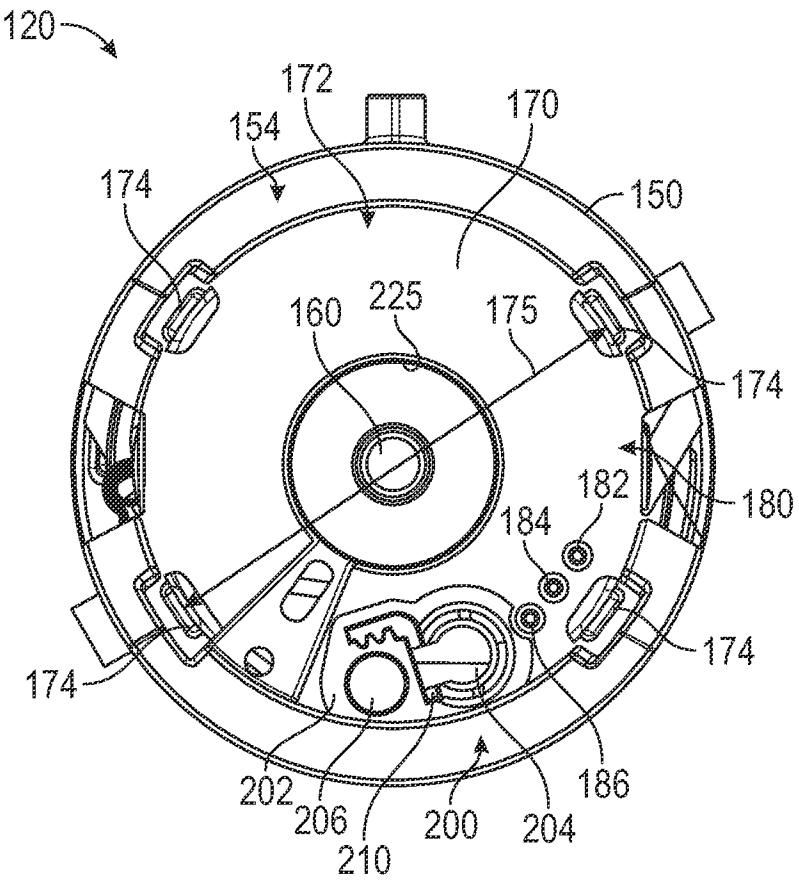
FIGS. 7, 8 are end views of the perforating gun of FIG. 3.
Figure 7:
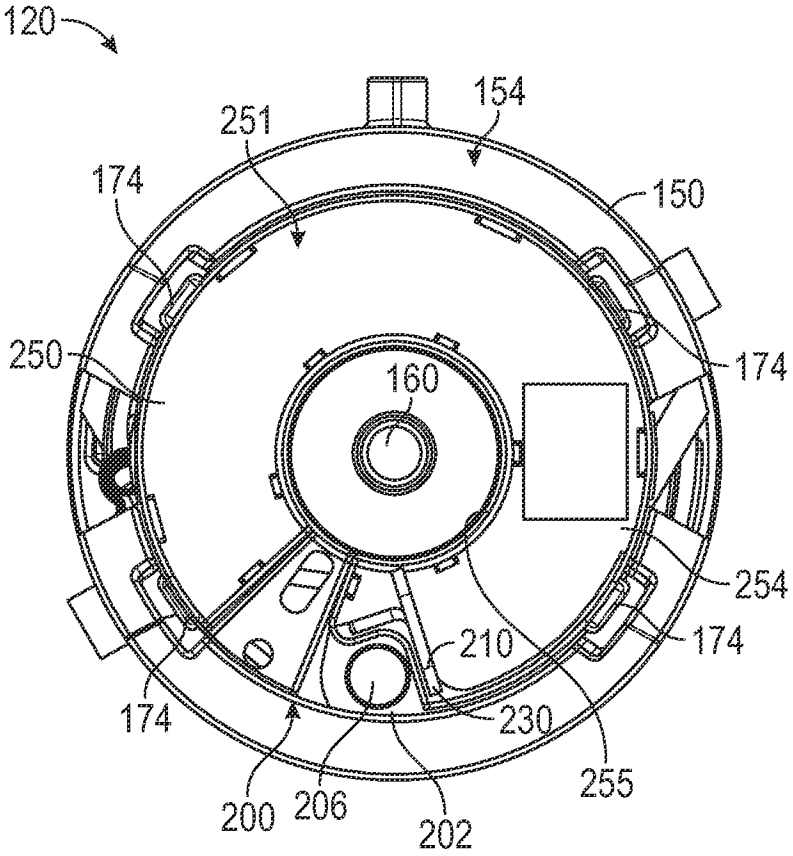

As shown particularly in FIGS. 6, 8, in this exemplary embodiment, the lower end 154 of lower endplate 150 includes an annular lower face 170 and a generally cylindrical inner surface extending therefrom which forms an annular initiator receptacle 172. Additionally, a plurality of circumferentially spaced connectors or tabs 174 extend from lower face 170 and are positioned circumferentially about central axis 105. In some embodiments, each tab 174 is spaced approximately 180 degrees from another of the plurality of tabs 174 whereby an inner diameter 175 extends between the opposing pair of tabs 174; however, the circumferential spacing of tabs 174 may vary. As will be described further herein, tabs 174 of lower endplate 150 may be used to slidably couple initiator assembly 250 with lower endplate 150 whereby an electrical connection may be formed between initiator assembly 250 and charge carrier assembly 120.

Figure 9:
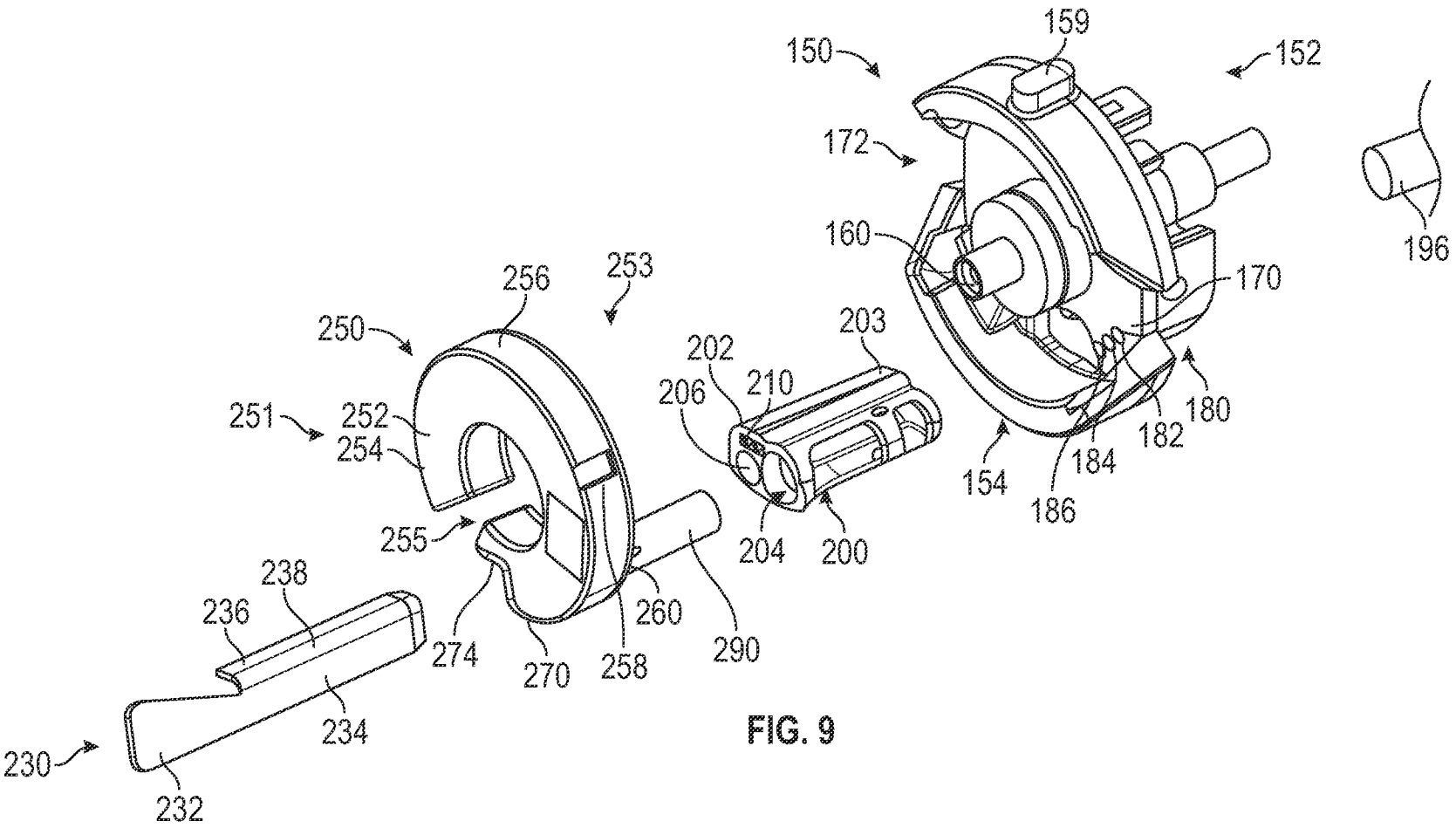
FIGS. 9, 10 are exploded perspective views of embodiments of an endplate and initiator assembly of the perforating gun of FIG. 3.
Figure 10:
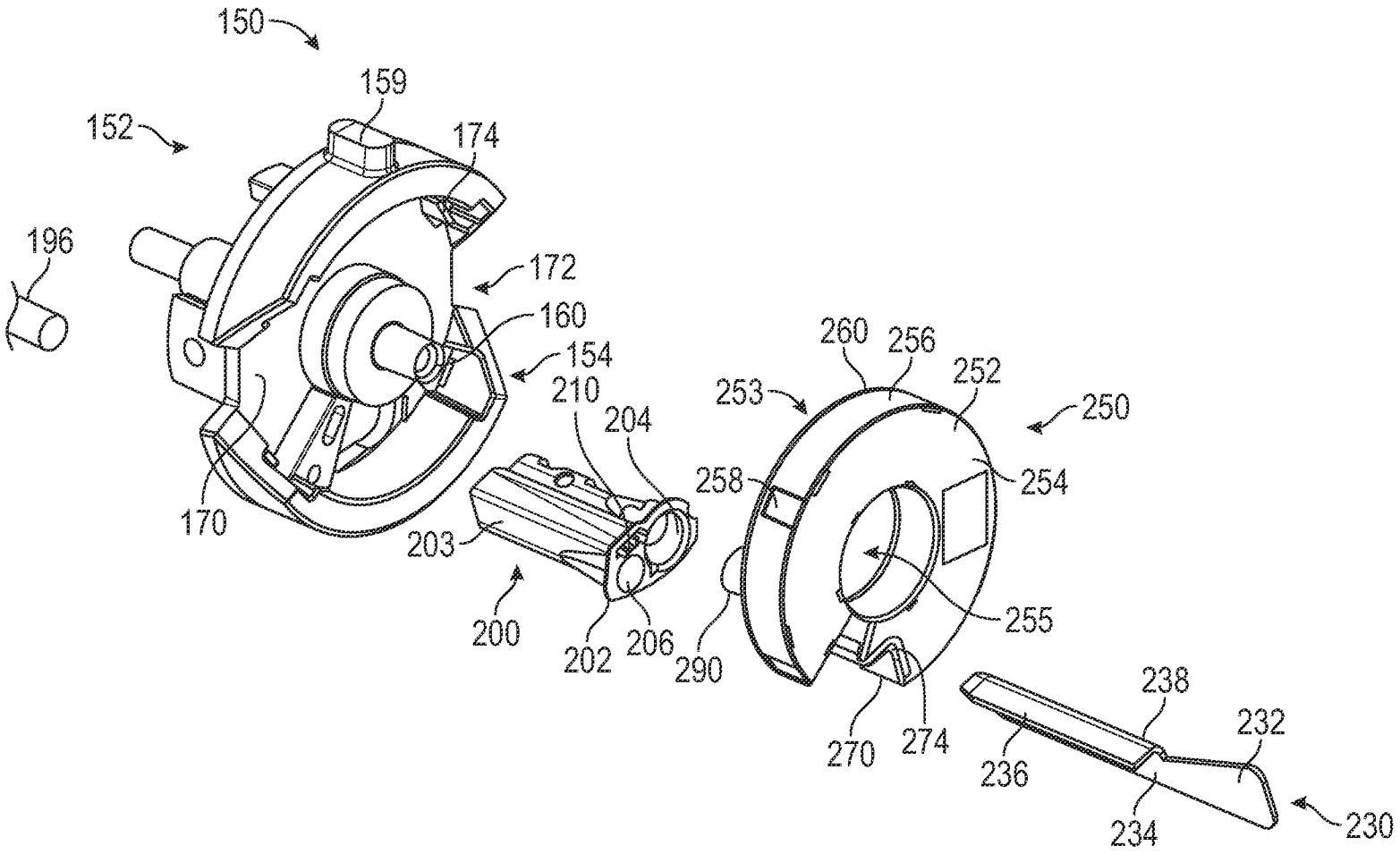

As shown particularly in FIGS. 8-10, in this exemplary embodiment, lower endplate 150 also includes a multi-contact electrical connector or harness 180 that is formed in or coupled to lower face 170. Electrical connector 180 may extend generally parallel with central axis 105 of perforating gun 100 but may be radially offset from central axis 105. In some embodiments, at least a portion of electrical connector 180 may axially overlap (i.e., occupy the same position along central axis 105) with lower electrical connector 160 of charge carrier assembly 120 to thereby minimize the overall axial length of charge carrier assembly 120 and perforating gun 100.

Electrical connector 180 of lower endplate 150 may provide electrical signal connectivity between initiator assembly 250 and components of tool string 20 positioned both uphole and downhole from perforating gun 100. In this exemplary embodiment, electrical connector 180 may include a plurality of female electrical contacts or receptacles 182, 184, and 186, respectively, each extending towards the upper end 152 of lower endplate 150 from lower face 170. Prior to assembly of perforating gun 100, female electrical contacts 182, 184 may be electrically connected or wired to signal conductors or electrical cables 144, 164, respectively. Thus, electrical contact 182 may be used to transmit signals uphole from perforating gun 100 or receive signals transmitted to perforating gun 100 from firing panel 15 whereby electrical connector 150 comprises a line-in to perforating gun 100. Additionally, electrical contact 184 may transmit signals and/or receive signals from components positioned downhole from perforating gun 100 whereby lower electrical connector 160 comprises a line-out of perforating gun 100.

Additionally, in this exemplary embodiment, electrical contact 186 may be electrically connected or wired to a signal conductor or electrical cable 188 of perforating gun 100 which may comprise a ground cable 188 of the perforating gun 100. Ground cable 188 extends from electrical connector 180 to a ground spring 125 coupled to a generally cylindrical outer surface of the charge carrier 122 of charge carrier assembly 120. Additionally, ground spring 125 extends radially outwards from charge carrier 122 and slidably contacts the inner surface 106 of outer housing 102 when charge carrier assembly 120 is received therein to establish an electrical connection between ground cable 188 and outer housing 102, which may serve as a grounding path between initiator assembly 250 (electrically connected to ground cable 188 via electrical contact 186 as will be discussed further herein) and outer housing 102. In some embodiments, charge carrier 122 may comprise a plurality of ground springs 125 circumferentially spaced about the outer surface thereof.

Although in this exemplary embodiment electrical connector 180 comprises a component of lower endplate 150, in other embodiments, electrical connector 180 may be separate and distinct from lower endplate 150. For example, in other embodiments, electrical connector 180 may be loosely positioned within charge carrier 122. In still other embodiments, electrical connector 180 may comprise a plurality of separate electrical connectors (e.g., a first electrical connector 182, a second electrical connector 184, and/or a third electrical connector 186) each of which may be coupled to lower endplate 150, loosely positioned within charge carrier 122, coupled to upper endplate 130, etc.

In this exemplary embodiment, lower endplate 150 of charge carrier assembly 120 further includes a detonator holder or harness 200 coupled to lower face 170 of lower endplate 150. Similar to electrical connector 180 described above, detonator holder 200 extends generally parallel with central axis 105 of perforating gun 100 but is radially offset from central axis 105. In some embodiments, at least a portion of detonator holder 200 may axially overlap both electrical connectors 160, 180 of charge carrier assembly 120 to thereby minimize the overall axial length of charge carrier assembly 120 and perforating gun 100.

Detonator holder 200 may provide ballistic signal connectivity between a detonator 290 of initiator assembly 250 and the det cord 196 of perforating gun 100. In some embodiments, detonator holder 200 comprises a first or lower end 202 configured to couple with the lower face 170 of lower endplate 150, a first or detonator passage 204, and a second or cord passage 206. Detonator passage 204 may extend longitudinally into detonator holder 200 from lower end 202 while the cord passage 206 may extend longitudinally into detonator holder 200 from a second or upper end 203 of holder 200 that is opposite lower end 202. At least a portion of the detonator holder 204 may axially overlap the cord passage 206. Additionally, passages 204, 206 each extend parallel with, but are radially offset from, central axis 105 of perforating gun 100. Detonator passage 204 is configured to receive the detonator 290 of initiator assembly 250 when assembly 250 is coupled to lower endplate 150 while cord passage 206 is configured to receive an end of the det cord 196 which may be ballistically coupled to the shaped charges 190 of perforating gun 100.

Additionally, detonator holder 200 may include an L-shaped interrupter receptacle or slot 210 positioned directly between passages 204, 206. Interrupter slot 210 may slidably receive an interrupter 230 of perforating gun 100. When interrupter 230 is received in interrupter slot 210 of detonator holder 200, interrupter 230 may be generally configured to interrupt or block the transmission of a ballistic signal from detonator 290 to det cord 196 when interrupter 230 in the event of an inadvertent detonation of detonator 290.

In some embodiments, interrupter 230 may generally include a tab or handle 232, a first plate 234 that is co-planar with handle 232, a second plate 236 extending at a non-zero angle (e.g., an angle extending approximately between 60 degrees and 120 degrees) relative to first plate 234, and a bend 238 extending between plates 234, 236. When interrupter 230 is received in interrupter slot 210, first plate 234 may be positioned circumferentially between passages 204, 206 of detonator holder 200 while second plate 236 may be positioned radially between cord receptacle 206 and central axis 105 of perforating gun 100. In some embodiments, interrupter 230 may be formed from or comprise a hard metallic material such as, for example, an alloy steel like 4130 or 4140 alloy steel, or other materials such as hardened stainless steel and the like; however, in other embodiments, the materials forming interrupter 230 may vary. Bend 238 may increase a resistance of interrupter 230 to bending of interrupter 230 about a deformation axis that is co-planar with first plate 234 of interrupter 230. However, in other embodiments, the configuration of interrupter 230 may vary. For example, interrupter 230 may comprise a single planar member in certain embodiments.

While in this exemplary embodiment detonator holder 200 comprises a component of lower endplate 150, in other embodiments, electrical connector 180 may be separate and distinct from lower endplate 150. For example, in other embodiments, electrical connector 180 may be loosely positioned within charge carrier 122 or coupled to upper endplate 130. Additionally, in other embodiments, detonator holder 200 may not include interrupter slot 210 and may not be configured to receive an interrupter such as interrupter 230.

Initiator assembly 250 of perforating gun 100 may control the operation of perforating gun 100, including the detonation of shaped charges 190, in response to the transmission of one or more signals individually addressed to the imitator assembly 250 from the surface (e.g., from firing panel 15 shown in FIG. 2). In this exemplary embodiment, initiator assembly 250 has a first or lower end 251, a second or upper end 253 opposite lower end 251 and comprises an arcuate outer housing 252, an electrical switch 280, and detonator 290. In this exemplary embodiment, initiator assembly 250 is generally arcuate in shape and comprises a central opening or passage 255 through which the central axis 105 of perforating gun 100 may extend. Lower electrical connector 160 may extend at least partially through the central passage 255 of initiator assembly 250 whereby initiator assembly 250 axially overlaps at least a portion of lower electrical connector 160.

Figure 12:
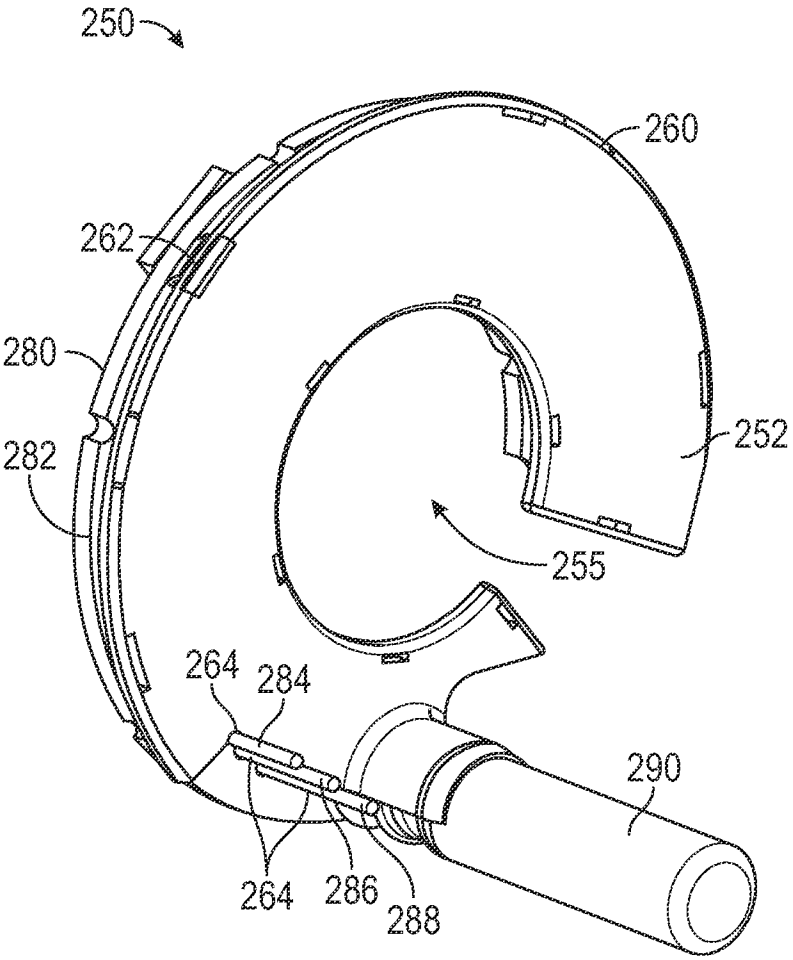
FIGS. 11, 12 are perspective views of the initiator assembly of FIGS. 9, 10.
Figure 11:
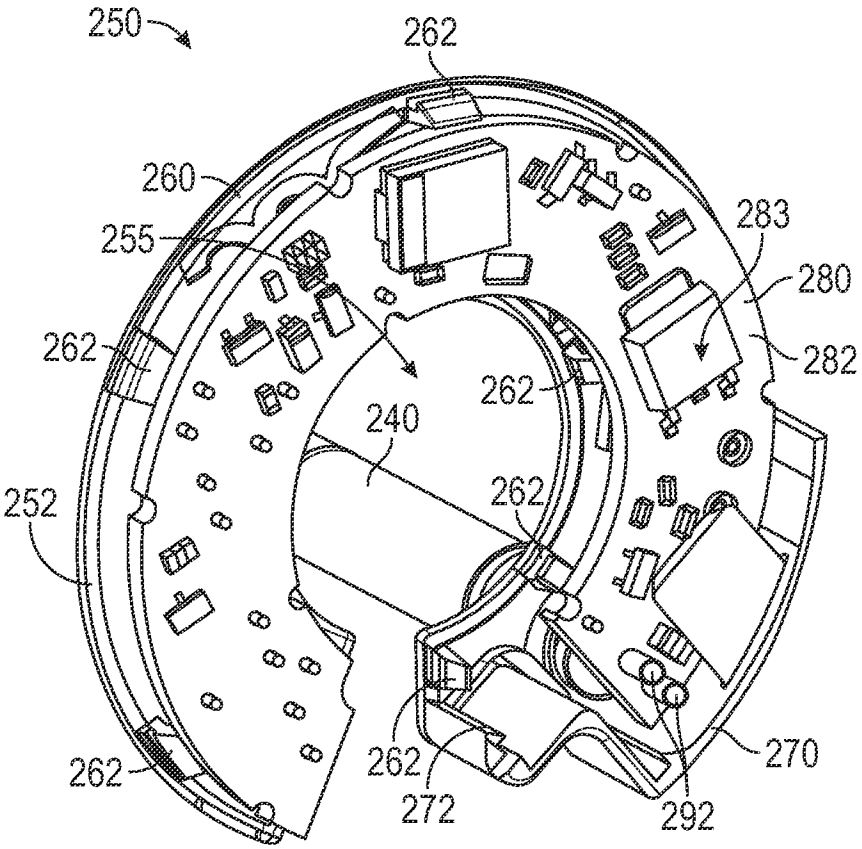
Figure 15:
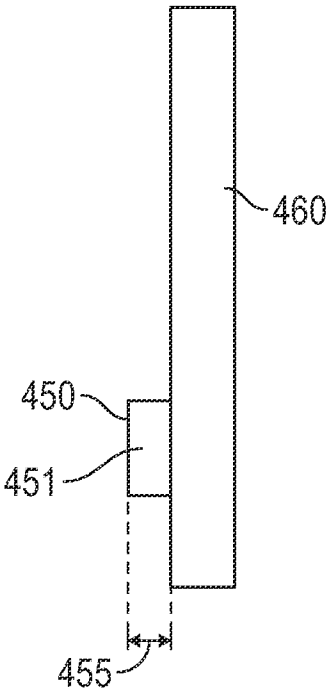
FIG. 15 is a side view of the initiator assembly of FIG. 14.
Figure 14:
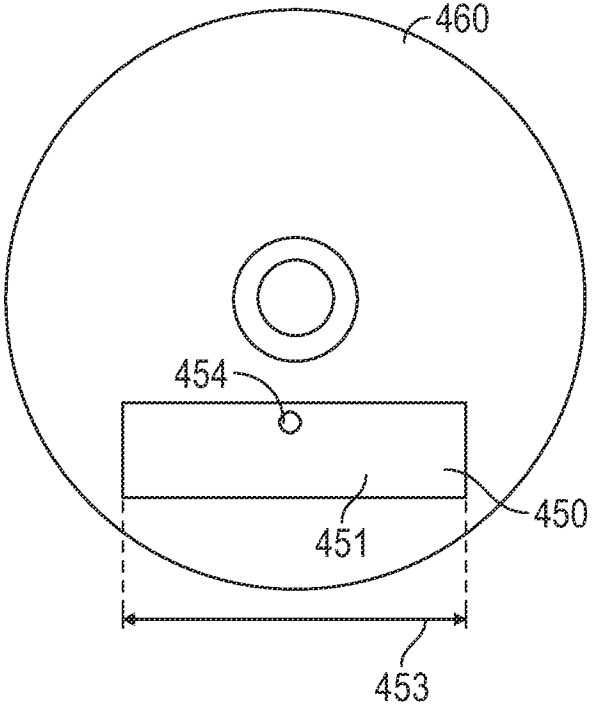
FIG. 14 is a front view of another embodiment of an initiator assembly.
Figure 13:
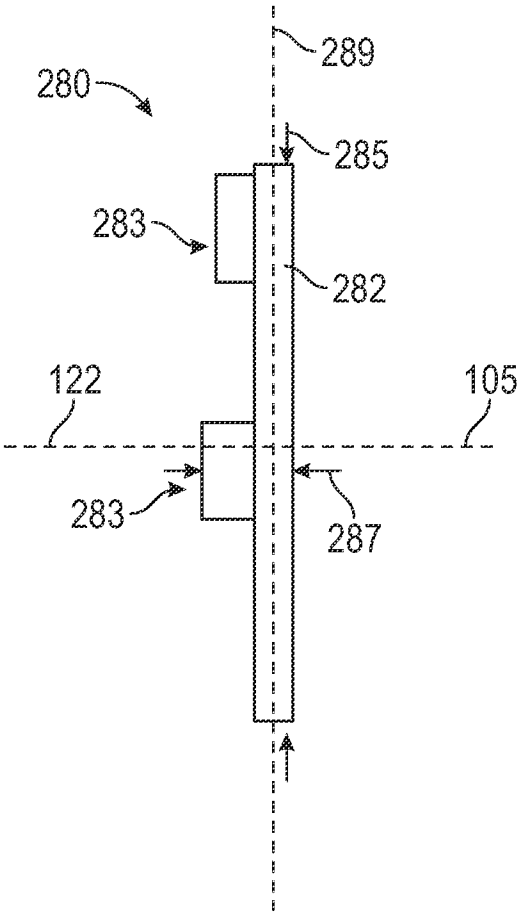
FIG. 13 is a side view of an embodiment of an electrical switch of the initiator assembly of FIGS. 9, 10.
Figure 16:
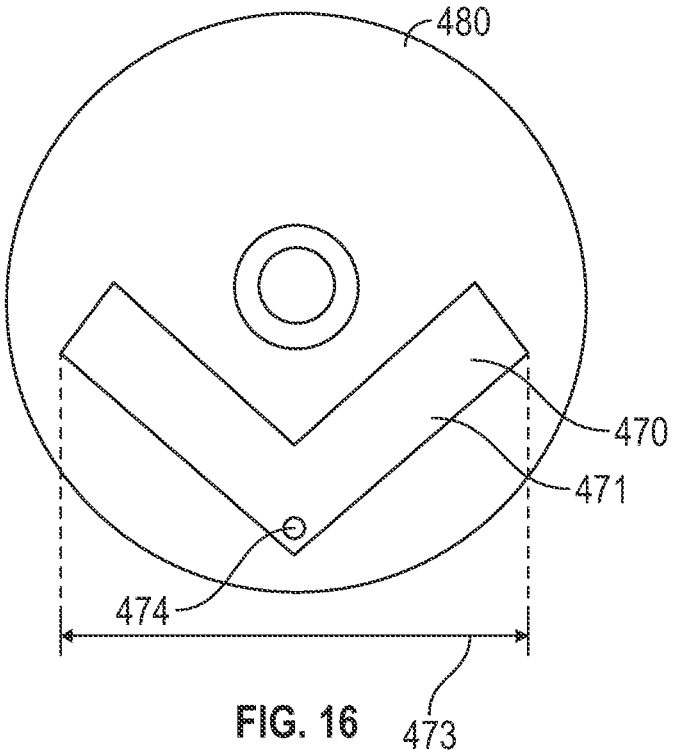
FIG. 16 is a front view of another embodiment of an initiator assembly.
Figure 17:
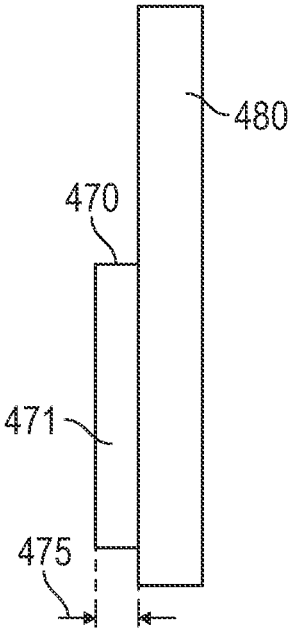
FIG. 17 is a side view of the initiator assembly of FIG. 16.

As shown particularly in FIGS. 12, 13, electrical switch 280 of initiator assembly 250 may comprise a printed circuit board (PCB) 282 upon which a plurality of electronic components (indicated generally by arrow 283 in FIGS. 12, 13) may be positioned. Electrical switch 280 has a maximum length 287 that is less than a maximum outer diameter or width 285 of the electrical switch 280. As used herein, the maximum width 285 of initiator assembly 250 refers to the maximum width of electrical switch 280 in a radial or orthogonal direction relative to the central axis 105 of perforating gun 100 (including the central axis 123 of charge carrier 122) while the maximum length 287 of electrical switch 280 refers to a maximum length of electrical switch 280 in a direction parallel with the central axis 105 of perforating gun 100 (including the central axis 123 of charge carrier 122). Additionally, only the length and width of PCB 282 and the electronic components 283 positioned on the PCB 282 are considered for purposes of determining the maximum length 287 and maximum width 285 of electrical switch 280. Thus, at least in this exemplary embodiment, the lengths and widths of housing 250, detonator 290, and det cord 196 are not considered for determining the maximum length 287 and maximum width 285 of electrical switch 280.

As shown particularly in FIG. 13, in this exemplary embodiment, the PCB 282 of electrical switch 280 is oriented parallel an orthogonal plane 289 which extends orthogonal the central axes 105, 125 of perforating gun 100 and charge carrier 122, respectively, following the assembly of perforating gun 100. By orienting PCB 282 orthogonal central axis 105, 125 in this exemplary embodiment, the maximum length 287 of electrical switch 280 may be minimized.

In some embodiments, a ratio of the maximum length 287 of electrical switch 280 to the maximum width 285 of electrical switch 280 is between 1:1 and 1:6. In certain embodiments, a ratio of the maximum length 287 of electrical switch 280 to the maximum width 285 of electrical switch 280 is less than 1:1 (e.g., the maximum length 287 is less than maximum width 285). In certain embodiments, a ratio of the maximum length 287 of electrical switch 280 to the maximum width 285 of electrical switch 280 is less than 1:3. In certain embodiments, a ratio of the maximum length 287 of electrical switch 280 to the maximum width 285 of electrical switch 280 is less than 1:6. In some embodiments, the ratio of the maximum length 287 of electrical switch 280 to the maximum width 285 of electrical switch 280 is between 1:1 and 1:3. In certain embodiments, the ratio of the maximum length 287 of electrical switch 280 to the maximum width 285 of electrical switch 280 is between 1:1 and 1:2. However, in still other embodiments, the ratio of maximum width 285 to maximum length 287 of electrical switch 280.

As will be described further herein, electrical switch 280 having a maximum length 287 that is less than a maximum width 285 thereof allows for the minimization of the axial length 287 of electrical switch 280 and, in-turn, the minimization of the axial length of perforating gun 100. By minimizing the axial length of perforating gun 100, tool string 20 may be more conveniently transported through wellbore 13 (e.g., friction between tool string 20 and the inner surface of casing string 12 may be minimized). Additionally, by minimizing the length of each perforating gun 100, the number of perforating guns 100 which an individual tool string 20 may contain for a predefined maximum permissible length of the tool string 20 may be maximized. For example, surface assembly 11 may be incapable of inserting a tool string 20 exceeding a maximum permissible length into casing string 12. For example, a lifting crane of surface assembly 11 may have a maximum height at which it may operate, thereby limiting tool string 20 to a total length that is less than the maximum lifting height of the crane of surface assembly 11 minus the height of the surface equipment to which tool string 20 must be lifted over as it is inserted into casing string 12. Thus, by minimizing the axial length of each perforating gun 100, the number of perforating guns 100 that can be fit into a tool string 20 that is at or less than the maximum permissible length thereof may be maximized. The increased number of perforating guns 100 in tool string 20 may allow for the stimulation of an increased number of production zones of formation 17, thereby potentially increasing the production of hydrocarbons from formation 17.

As shown particularly in FIGS. 9-12, in this exemplary embodiment, housing 252 of initiator assembly 250 generally includes an arcuate first or lower housing member 254, an arcuate second or upper housing member 260, and a latch member 270. Lower housing member 254 comprises a curved outer surface 256 which includes a plurality of circumferentially spaced grooves or receptacles 258 each configured to receive one of the tabs 174 of lower endplate 150 to releasably couple initiator assembly 250 with lower endplate 150. In some embodiments, housing 252 may act to retain detonator 290 and thus may also be referred to herein as detonator retention member 252.

In some embodiments, tabs 174 may comprise flexible snap connectors which snap into the corresponding receptacles 258 of lower housing 254 to form a snap-fitting or releasable connection between initiator assembly 250 and lower endplate 150. Particularly, the inner diameter 175 defined by a pair of opposing tabs 174 may be equal to or slightly less than a maximum outer diameter of initiator assembly 250 and thus, as initiator assembly 250 is inserted into initiator receptacle 172 of lower endplate 150, tabs 174 may flex radially outwardly prior to being received in receptacles 258 of lower housing 254, thereby securing initiator assembly 250 to lower endplate 150 whereby relative axial movement therebetween is restricted.

In other embodiments, a mechanism other than tabs 174 and receptacles 258 may be utilized to retain initiator assembly 250 with lower endplate 150. For example, one or more fasteners (e.g., threaded fasteners, rivets, magnetic fasteners, etc.) may be utilized for coupling initiator assembly 250 with lower endplate 150 in either a releasable or permanent fashion. Additionally, in other embodiments, initiator assembly 250 may not couple to lower endplate 150. For example, initiator assembly 250 may couple to upper endplate 130. In still other embodiments, initiator assembly 250 may couple directly with charge carrier 122 or may be secured to charge carrier 122 via an intermediate member.

In this exemplary embodiment, upper housing member 260 of housing 252 comprises a plurality of connectors 262, such as snap connectors positioned along a periphery of upper housing 260. Connectors 262 of upper housing member 260 may be receivable in corresponding receptacles of lower housing member 254 to releasably couple upper housing member 260 and lower housing member 254 with electrical switch 280 received therebetween. Connectors 262 may also secure electrical switch 280 to upper housing 260 in a predefined positional relationship. Additionally, upper housing member 260 may comprise a plurality of openings or recesses 264 as will be described further herein.

Latch member 270 may also comprise a plurality of opening or recesses (not shown in FIGS. 4-12) and one or more connectors 272, such as snap connectors, for releasably coupling latch member 270 with the lower housing member 254 of housing 252. Additionally, as shown particularly in FIGS. 9, 10, an opening or passage 274 is formed between latch member 270 and the housing members 254, 260 of housing 252, where the opening 274 extends entirely through housing 252 between the ends 251, 253 of initiator assembly 250. Opening 274 of housing 252 is configured to slidably receive interrupter 230 such that interrupter 230 may be at least partially inserted through opening 274. In some embodiments, the components of housing 252 (e.g., members 254, 260, and 270) may be formed from a hard plastic material, such as glass filled nylon, Ultem® (polyetherimide), and other materials having relatively high strength and stability up to at least 350° F.; however, in other embodiments, the materials forming housing 252 may vary.

As described above, electrical switch 280 of initiator assembly 250 may comprise a PCB 282 upon which a plurality of electronic components 283 may be positioned. Additionally, a plurality of electrical male contacts 284, 286, and 288, each extending through apertures 264 of upper housing member 260 and the corresponding apertures of latch member 270. In some embodiments, the electronic components 283 of electrical switch 280 may comprise a processor, a memory. For example, electrical switch 280 may comprise a digital, addressable switch having a unique identifier stored in the memory of electronic components 283 (in permanent or rewritable memory) and associated with the initiator assembly 250. Initiator assembly 250 may thus actuate or detonate the detonator 290 associated with the initiator assembly 250 in response to receiving a firing signal uniquely addressed to the identifier of the initiator assembly 250. However, in other embodiments, the configuration of electrical switch 280 may vary. For example, in other embodiments, electrical switch 280 may comprise an analog electrical switch such as a diode-based switch.

Although in this exemplary embodiment, electrical switch 280 is housed within the housing 252 of initiator assembly 250, in other embodiments, electrical switch 280 may be located external the housing 252. For example, in some embodiments, electrical switch 280 may be located within an interior of the charge carrier 122 while housing 252 is located external the interior of charge carrier 122.

In this exemplary embodiment, each male contact 284, 286, and 288 of switch 280 is slidably received in a corresponding female contact 182, 184, and 186, respectively, of electrical connector 180 in response to the coupling of initiator assembly 250 with lower endplate 150. Particularly, in response to the coupling of initiator assembly 250 with lower endplate 150, an electrical connection may be formed between switch 280 and electrical cables 144, 164, and 188 of perforating gun 100. Thus, at least in this exemplary embodiment, switch 280 does not need to be manually wired to cables 144, 164, and 188, and instead, initiator assembly 250 need only be slid or snapped into lower endplate 150 to form an electrical connection between switch 280 and electrical cables 144, 164, and 188.

Detonator 290 of initiator assembly 250 may comprise an explosive material received within a housing thereof and may be rigidly coupled or affixed (e.g., soldered, etc.) to the PCB 282 of switch 280 via housing 252 whereby relative movement between detonator 290 and switch 280 is restricted. In other words, in this embodiment, housing 252 couples detonator 290 to PCB 282 such that relative movement between detonator 290 and switch 280 is restricted. Detonator 290 may comprise a pair of electrical terminals 292 coupled to PCB 282 to form an electrical connection between detonator 290 and switch 280. Detonator 290 may be slidably received in the detonator passage 204 of detonator holder 200 as the initiator assembly 250 is slid or snapped into lower endplate 150, thereby placing detonator 290 into proximity with det cord 196 (received in cord passage 206 of detonator holder 200) whereby a ballistic signal may be transmitted from detonator 290 to det cord 196 when interrupter 230 is not positioned in the interrupter slot 210 of detonator holder 200.

In other words, when interrupter 230 is not present within interrupter slot 210, the detonation of detonator 290 (initiated by switch 280 in response to switch 280 receiving a firing signal from the surface) may result in the detonation of shaped charges 190 of perforating gun 100. Conversely, when interrupter 230 is present within interrupter slot 210, the detonation of detonator 290 does not result in the detonation of any of the shaped charges 190 of perforating gun 100 due to interrupter 230 blocking the ballistic signal transmitted from detonator 290 (following the detonation thereof) towards det cord 196. Thus, following the coupling of initiator assembly 250 with the lower endplate 150 of charge carrier assembly 120, interrupter 230 may be removed from interrupter slot 210 to arm perforating gun 100 whereby a firing signal transmitted to the switch 280 of initiator assembly 250 causes the detonation of one or more shaped charges 190 of perforating gun 100.

As shown particularly in FIG. 4, upper bulkhead sub 350 of perforating gun 100 generally comprises a generally cylindrical bulkhead body 352 having a central passage 354 extending therethrough and a generally cylindrical outer surface 356 upon which a pair of releasable connectors 358 are formed. One of the pair of connectors 358 may releasably or threadably connect to one of the threaded connectors 108 of outer housing 102. An electrical connector 360 is positioned within the central passage 354 of bulkhead body 352 and is configured to transmit signals between the charge carrier assembly 120 of perforating gun 100 and components positioned uphole from charge carrier assembly 120 including components positioned at the surface such as firing panel 15. Electrical connector 360 may contact the upper end 143 of the upper electrical connector 140 of charge carrier assembly 120. Additionally, bulkhead body 352 and electrical connector 360 are configured to restrict the transmission of pressure (e.g., fluid pressure) through central passage 354 whereby charge carrier assembly 120 is isolated from pressure within at least a portion of the central passage 354.

Lower bulkhead sub 400 is similar in configuration to upper bulkhead sub 350 and generally comprises a generally cylindrical bulkhead body 402 having a central passage 404 extending therethrough and a generally cylindrical outer surface 406 upon which a pair of releasable connectors 408 are formed. One of the pair of connectors 408 may releasably or threadably connect to one of the threaded connectors 108 of outer housing 102. An electrical connector 410 is positioned within the central passage 404 of bulkhead body 402 and is configured to transmit signals between the charge carrier assembly 120 of perforating gun 100 and components positioned downhole from charge carrier assembly 120, such as setting tool 50. Electrical connector 410 may contact the lower end 163 of the lower electrical connector 160 of charge carrier assembly 120. Additionally, bulkhead body 402 and electrical connector 360 are configured to restrict the transmission of pressure through central passage 404 whereby charge carrier assembly 120 is isolated from pressure within at least a portion of the central passage 404.

While in this exemplary embodiment perforating gun 100 comprises bulkhead subs 350, 400, in other embodiments, perforating gun 100 may not include bulkhead sub 350 and/or 400. For example, outer housing 102 of perforating gun 100 may connect directly with direct connect sub 28 and/or PSFH 40. In some embodiments, in lieu of bulkhead subs 350, 400, perforating gun 100 may include pressure bulkheads/electrical connectors contained within outer housing 102.

In some embodiments, at least some components of perforating gun 100 may be assembled at a remote location distal the wellsite (e.g., wellsite 13) prior to transporting perforating gun 100 to the wellsite for performing a perforating operation. For example, at a remote location (e.g., a facility used to manufacture one or more perforating guns 100) charge carrier assembly 120 may be assembled by coupling upper electrical connector 140 with upper endplate 130, coupling lower electrical connector 160 with lower endplate 150, and wiring electrical cables 144, 164, and 188 with female electrical contacts 182, 184, and 186, respectively, of the electrical connector 180 of lower endplate 150. Additionally, ground cable 188 may be connected to ground spring 125. Further, one or more of the shaped charges 190 may be coupled to charge carrier 122, det cord 196 may be ballistically coupled to each shaped charge 190, and an end of det cord 196 may be inserted into the cord passage 206 of detonator holder 200. Further, the endplates 130, 150 of charge carrier assembly 120 may be coupled to charge carrier 122 to complete the assembly of charge carrier assembly 120.

At the remote location, following the assembly of charge carrier assembly 120, charge carrier assembly 120 may be inserted into outer housing 102 of perforating gun 100. In some embodiments, a radially extending tab 159 of lower endplate 150 may be received in a groove formed in the inner surface of housing 102 to orient charge carrier assembly 120 within outer housing 102.

At the remote location, following the insertion of charge carrier assembly 120 into outer housing 102, interrupter 230 may be manually inserted through the opening 274 formed in the housing 252 of initiator assembly 250, thereby coupling interrupter 230 with initiator assembly 250. Following the insertion of interrupter 230 into the opening 274 of initiator assembly 250, initiator assembly 250 (which may also be pre-assembled at a location remote from the wellsite) may be inserted along central axis 105 into the initiator receptacle 172 of lower endplate 150 whereby male electrical contacts 280, 284, and 286 of switch 280 are slidably inserted into the female contacts 182, 184, and 186, respectively, of charge carrier assembly 120 and an electrical connection is formed between the electrical switch 280 of initiator assembly 250 and the electrical cables 144, 164, and 188 of charge carrier assembly 120. In some embodiments, initiator assembly 250 may be snapped into initiator receptacle 172 forming a snap fit therebetween via tabs 174; however, in other embodiments, other features or mechanisms for retaining initiator assembly 250 with upper endplate 130 may be employed such as fasteners and the like. In other embodiments, interrupter 230 may be inserted into slot 210 prior to being coupled to initiator assembly 250. Bulkhead sub 400 may then be coupled to the end of outer housing 102 (bulkhead sub 350 may be preassembled with outer housing 102 at a remote location) and an endcap (not shown) may be coupled to the ends of bulkhead sub 400. Following the connection of bulkhead sub 400 with outer housing 102, the now assembled perforating gun 100 may be transported from the remote location to the wellsite (e.g., wellsite 13) for assembly with the other components of tool string 20.

At the wellsite, prior to being assembled with tool string 20, the endcaps may be removed from outer housing 102 and interrupter 230 may be manually removed (e.g., via handle 232) from the interrupter slot 210 of the detonator holder 200, thereby arming perforating gun 100 such that a ballistic connection is formed between the detonator 290 of initiator assembly 250 and the det cord 196 ballistically coupled to the one or more shaped charges 190 of perforating gun 100. The outer housing 102 of perforating gun 100 may then be coupled (e.g., threadably coupled) to components of tool string 20 and the assembled tool string 20 may be lowered into a wellbore (e.g., wellbore 13) along a wireline (e.g., wireline 22) that is in signal communication with switch 280 of initiator assembly 250. Once perforating gun 100 is positioned at a desired location in the wellbore 13, one or more signals may be transmitted from the surface (e.g., from firing panel 15 of surface assembly 11) to the electrical switch 280 of perforating gun 100 to thereby detonate the one or more shaped charges 190 of perforating gun 100. In some embodiments, the one or more signals may include an identifier uniquely identifying the electrical switch 280 and which is stored in a memory of electrical switch 280.

Although initiator assembly 250 is shown as arcuate in shape in FIGS. 4-13, in other embodiments, the shape of initiator assembly 250 may vary. For example, referring briefly to FIGS. 14-17, embodiments of additional initiator assemblies 450, 470 are shown in FIGS. 14, 15 and FIGS. 16, 17, respectively. Initiator assembly 450 shown in FIGS. 14, 15 may couple to an endplate 460 of a charge carrier assembly similar in configuration to charge carrier assembly 120. Similarly, initiator assembly 470 shown in FIGS. 16, 17 may couple to an endplate 480 of a charge carrier assembly similar in configuration to charge carrier assembly 120.

Initiator assembly 450 comprises an electrical switch 451 which is generally rectangular in shape and has a maximum axial length 455 which is less than a maximum width 453 of the electrical switch 451. Initiator assembly 470 comprises an electrical switch 471 which is V-shaped and also has a maximum axial length 475 which is less than a maximum width 473 of the electrical switch 471. Electrical switches having a maximum width greater than a maximum length thereof may comprise other shapes in addition to those of electrical switches 451, 471 shown in FIGS. 14, 15 and FIGS. 16, 17, respectively.

Electrical switch 452, 472 may each include a PCB and electronic components having features in common with PCB 282 and electronic components 283 of initiator assembly 250. For example, electrical switches 451, 471 may each comprise a processor and a memory including a unique identifier saved therein which may be matched with an identifier included in a firing signal transmitted from a surface assembly. Further, each initiator assembly 450, 470 includes a detonator 454, 474, respectively, which is in signal communication with the corresponding electrical switch 451, 471. Detonators 454, 474 may be similar in configuration to detonator 290 described above. Detonators 454, 474 may be directly connected to electrical switches 451, 471, respectively, (e.g., soldered thereto) or connected via intervening electrical cables. Electrical switches 451, 471 may detonate detonators 454, 474, respectively, in response to receiving a firing signal uniquely addressed to the electrical switch 451, 471. Detonators 454, 474 may in-turn detonate one or more shaped charges ballistically coupled to the detonator 454, 474.

wellbore 13 wellbore 13 While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A perforating gun system, comprising:

an outer housing;

a charge carrier assembly slidably receivable in the outer housing, wherein the charge carrier assembly comprises a charge carrier having a central axis, a first endplate coupled to a first end of the charge carrier, and a second endplate coupled to a second end of the charge carrier; and an initiator assembly comprising a digitally addressable electrical switch, wherein the electrical switch has a maximum length extending in a direction parallel to the central axis that is less than a maximum width of the electrical switch extending in an orthogonal direction relative to the central axis;

wherein the electrical switch is configured to detonate a detonator of the perforating gun system in response to receiving a firing signal;

wherein the initiator assembly is receivable in a receptacle of the second endplate, the second endplate comprising a plurality of circumferentially spaced tabs configured to snap onto a housing of the initiator assembly in which the electrical switch is received.

2. The perforating gun system of claim 1, wherein the second endplate comprises a plurality of female electrical contacts and the initiator assembly comprises a plurality of male electrical contacts receivable in the plurality of female electrical contacts.

3. The perforating gun system of claim 1, further comprising an electrical connector which extends through a central passage of the second endplate and a central passage of the initiator assembly.

4. The perforating gun system of claim 1, further comprising:

an interrupter insertable through an opening formed in a housing that receives the electrical switch and into a detonator holder of the second endplate;

wherein the interrupter is configured to prevent a transfer of a ballistic signal between the detonator and a detonating cord receivable in the detonator holder when the interrupter is received in the detonator holder;

wherein the interrupter is configured to permit the transfer of the ballistic signal between the detonator and the detonating cord when the interrupter is received in the detonator holder.

5. The perforating gun system of claim 1, wherein a ratio of the maximum length to the maximum width of the electrical switch is less than 1:1.

6. The perforating gun system of claim 1, wherein a ratio of the maximum length to the maximum width of the electrical switch is less than 1:3.

7. The perforating gun system of claim 1, wherein a ratio of the maximum length to the maximum width of the electrical switch is less than 1:6.

8. The perforating gun system of claim 1, wherein the electrical switch is arcuate in shape.

9. The perforating gun system of claim 1, wherein the electrical switch is rectangular in shape.

10. The perforating gun system of claim 1, wherein the electrical switch is V-shaped.

11. The perforating gun system of claim 1, wherein a printed circuit board (PCB) of the electrical switch is oriented generally orthogonal the central axis.

12. The perforating gun system of claim 1, wherein the electrical switch comprises a printed circuit board (PCB) on which a processor and a memory are positioned, the memory storing a unique identifier specifically addressed to the electrical switch.

13. A charge carrier assembly for a perforating gun system, comprising:

a cylindrical charge carrier having a central axis;

a first endplate coupled to a first end of the charge carrier;

a second endplate coupled to a second end of the charge carrier; and an initiator assembly comprising a digitally addressable electrical switch, wherein the electrical switch has a maximum length extending in a direction parallel to the central axis that is less than a maximum width of the electrical switch extending in an orthogonal direction relative to the central axis;

wherein the electrical switch is configured to detonate a detonator in response to receiving a firing signal;

wherein the initiator assembly is receivable in a receptacle of the second endplate, the second endplate comprising a plurality of circumferentially spaced tabs configured to snap onto a housing of the initiator assembly in which the electrical switch is received.

14. The charge carrier assembly of claim 13, wherein the second endplate comprises a plurality of female electrical contacts and the initiator assembly comprises a plurality of male electrical contacts receivable in the plurality of female electrical contacts.

15. The charge carrier assembly of claim 13, further comprising an electrical connector which extends through a central passage of the second endplate and a central passage of the initiator assembly.

16. The charge carrier assembly of claim 13, further comprising an interrupter insertable through an opening formed in a housing of the initiator assembly that receives the electrical switch.

17. The charge carrier assembly of claim 13, wherein a ratio of the maximum length to the maximum width of the electrical switch is less than 1:1.

18. The charge carrier assembly of claim 13, wherein a ratio of the maximum length to the maximum width of the electrical switch is less than 1:3.

19. The charge carrier assembly of claim 13, wherein a ratio of the maximum length to the maximum width of the electrical switch is less than 1:6.

20. The charge carrier assembly of claim 13, wherein the electrical switch is arcuate in shape.

21. The charge carrier assembly of claim 13, wherein the electrical switch is rectangular in shape.

22. The charge carrier assembly of claim 13, wherein the electrical switch is V-shaped.

23. The charge carrier assembly of claim 13, wherein a printed circuit board (PCB) of the electrical switch is oriented generally orthogonal the central axis.

24. A method for assembling a charge carrier assembly for a perforating gun system, comprising:

(a) coupling a first endplate and a second endplate to a charge carrier having a central axis;

(b) inserting a detonator into a detonator holder of the second endplate; and (c) coupling an initiator assembly comprising a digitally addressable electrical switch to the charge carrier, wherein the electrical switch has a maximum length extending in a direction parallel to the central axis that is less than a maximum width of the electrical switch extending in an orthogonal direction relative to the central axis, and wherein the electrical switch is configured to detonate the detonator in response to receiving a firing signal, and wherein the second endplate comprises a plurality of circumferentially spaced tabs configured to snap onto a housing of the initiator assembly.

25. The method of claim 24, further comprising:

(d) inserting an interrupter through an opening formed in the housing of the initiator assembly.

26. The method of claim 24, wherein the second endplate comprises a plurality of female electrical contacts and the initiator assembly comprises a plurality of male electrical contacts receivable in the plurality of female electrical contacts.

27. The method of claim 24, wherein a ratio of the maximum length to the maximum width of the electrical switch is less than 1:1.

28. The method of claim 24, wherein a ratio of the maximum length to the maximum width of the electrical switch is less than 1:3.

29. The method of claim 24, wherein a ratio of the maximum length to the maximum width of the electrical switch is less than 1:6.

30. The method of claim 24, wherein the electrical switch is arcuate in shape.

31. The method of claim 24, wherein the electrical switch is rectangular in shape.

32. The method of claim 24, wherein the electrical switch is V-shaped.

33. The method of claim 24, wherein a printed circuit board (PCB) of the electrical switch is oriented generally orthogonal the central axis.

* * * * *